United States Patent [19]

Vogel

[11] 4,228,740

[45] Oct. 21, 1980

[54] TRANSVERSELY INTERCONNECTED TRUCKS

[75] Inventor: Hans H. Vogel, Tuttwil, Switzerland

[73] Assignee: Schweizerische Lokomotiv-und Maschinenfabrik, Winterthur, Switzerland

[21] Appl. No.: 923,297

[22] Filed: Jul. 10, 1978

[30] Foreign Application Priority Data

May 12, 1978 [CH] Switzerland ..... 5179/78

[51] Int. Cl.[2] ..... B61F 3/08; B61F 5/22; B61F 5/44

[52] U.S. Cl. ..... 105/168; 105/165; 105/176

[58] Field of Search ..... 105/165, 166, 167, 168, 105/176

[56] References Cited

U.S. PATENT DOCUMENTS 1,455,866 5/1923 Callot ..... 105/165

FOREIGN PATENT DOCUMENTS 196440 3/1958 Austria ..... 105/168
278337 3/1928 United Kingdom ..... 105/166

*Primary Examiner*—John J. Love
*Assistant Examiner*—Howard Beltran
*Attorney, Agent, or Firm*—Kenyon & Kenyon

[57] ABSTRACT

The coupling arrangement includes a longitudinally extending shaft, means for supporting the shaft on the vehicle body and a linkage which connects the trucks to the shaft. Each linkage employs a transverse steering rod which is articulated to the end of a truck at a predetermined connection point which lies in an inclined plane passing through a guide member connecting the truck to the vehicle body and through a transverse center plane of the vehicle body.

5 Claims, 5 Drawing Figures

-1-
M
S
E
P
H
I
II
III

V
22
20
2
P
4
23
14
12a
24
11
E
M
9
S
12
8
-1-
H1
21

2
22
4
IV
23
24
11
12a
15
9
12
1
21

TRANSVERSELY INTERCONNECTED TRUCKS

This invention relates to a transverse coupling arrangement for a rail vehicle.

Heretofore, it has been known to use transverse coupling arrangements for rail vehicles in order to compensate for lateral loads imposed upon the vehicle. In one known coupling arrangement for a vehicle having two trucks which are connected to a vehicle body via at least one guide member capable of transmitting lateral forces, use is made of a shaft which extends in a longitudinal direction of the vehicle and is supported on the vehicle body as well as a linkage which connects the shaft to the two trucks. The linkage is comprised of two swinging levers which are connected to the shaft in non-rotatable relation and two transverse steering rods, each of which is connected in an articulated manner to an end of a truck. As described in Swiss Pat. No. 328,306, the coupling arrangement couples the trucks in such a manner that the ends facing each other must always execute rotary excursion movements in the same sense inasmuch as rotary motion of one truck causes a corresponding rotary motion in the opposite direction of the other truck. The lateral coupling forces of opposite direction are then transmitted via the steering rods such that the reaction forces exert a moment on the vehicle body about the vertical center axis which, in turn, must be compensated by a corresponding force couple which acts on the vehicle body via a guide member on the two trucks.

In the known arrangements, the linkages which connect the trucks are arranged in a relatively high mounting position, for example, above the bogie frame, due to the relatively constrained space afforded by the construction of rail vehicles. Accordingly, the action lines of the transverse forces acting on a truck are at a relatively great height above the upper rail surfaces. This is unfavorable for the derailment safety of the vehicle. Thus, undesirable wheel-load relief can take place on the outside of a curve on the leading wheel set. For instance, when negotiating sharp banked curves, this can jeopardize the derailment safety of the vehicle under some travel conditions.

Accordingly, it is an object of the invention to avoid undesirable wheel-load relief in transversely coupled trucks.

It is an another object of the invention to improve the derailment safety of a rail vehicle.

It is another object of the invention to provide a transverse coupling arrangement of relatively simple construction for reducing the risk of derailment due to lateral forces on curves.

Briefly, the invention is directed to a transverse coupling arrangement for a rail vehicle which has at least two trucks each of which has at least two axles therein, a vehicle body and a pair of guide members wherein each guide member connects a respective one of the trucks to the vehicle body for the transmission of lateral forces.

The transverse coupling arrangement is comprised of a shaft which extends longitudinally of the vehicle body, means for supporting the means on the body and a linkage which connects the trucks to the shaft. In particular, the linkage includes a pair of pivotal levers which are connected to opposite ends of the shaft in non-rotatable relation and a pair of transverse steering rods. Each rod is articulated to an end of a respective truck which faces the other truck at a connection point which lies in an inclined plane passing through the guide member connecting the truck to the body and through a center plane of the body.

Because of the coupling arrangement, the forces acting on the two trucks result in two oppositely directed idealized transverse coupling forces of equal magnitude, the common action line of which passes through the transverse center plane. The inclined planes intersect at a low position which is advantageous for derailment safety and quiet running of the vehicle. In order to obtain a statically ideal transmission of the lateral forces, it is advantageous if the inclined planes intersect with the transverse center plane of the vehicle body at least approximately at a point coindicent with the plane of the upper surfaces of the track rails.

These and other objects and advantages of the invention will become more apparent from the following detailed description taken in conjunction with the accompanying drawings wherein.

Figures 1, 2, 3:
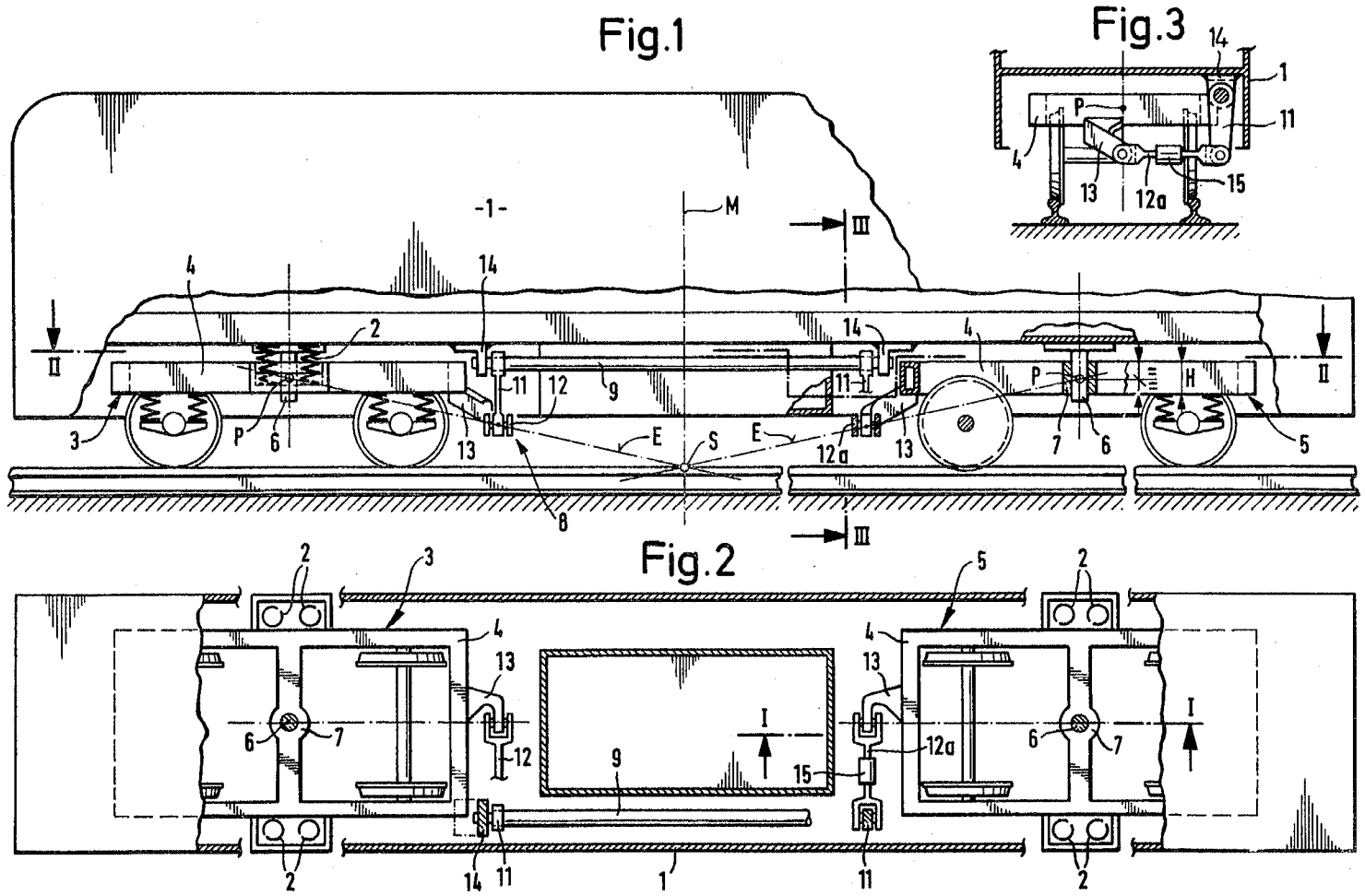
FIG. 1 illustrates a partial side view of a rail vehicle employing a transverse coupling arrangement in accordance with the invention.
FIG. 2 illustrates a view taken on line II—II of FIG. 1.
FIG. 3 illustrates a view taken on line III—III of FIG. 1.

Referring to FIGS. 1 and 2, the rail vehicle has a vehicle body 1 which is supported on two two-axle trucks 3, 5 via spring elements 2 of a secondary support. Each of the trucks 3, 5 has a frame 4 which is spring supported on wheel sets and is connected to the vehicle body 1 about a vertical axis N via a guide member comprised of a kingpin 6 which extends vertically from the body 1 and a bearing 7 in the center of the frame 4 which rotatably receives the kingpin 6.

The ends of the trucks 3, 5 which face each other are connected via a transverse coupling arrangement 8 which is comprised of a shaft 9 which extends longitudinally of the vehicle body 1, a means such as bearings 14 which rotatably support the shaft 9 on the vehicle body 1 and a linkage which connects the trucks 3, 5 to the shaft 9. This linkage includes a pair of pivotal levers 11 which are connected to the shaft 9 in non-rotatable (i.e. fixed) relation and which extend downwardly in the rest position as shown in FIG. 3. The linkage also includes a pair of transverse steering rods 12, **12*a* which are linked to the levers 11 so as to swivel in all directions and each is articulated to an end of a respective truck 3, 5 via a horn-shaped bracket 13. The rods 12, 12*a* are also articulated to the brackets 13** to swivel in all directions.

The bearings 14 which support the shaft may be of ball-joint type (not shown). The two swinging levers 11 can therefore swing sideways and transmit the respective rotary excursion motions of one truck 3, 5 to the other truck 5, 3.

As shown in FIG. 2, one of the steering rods **12*a* contains a pre-tensioned spring element 15 which insures the elasticity of the connection, in known manner, which is required for the proper operation of the transverse coupling arrangement, for example when negotiating sharp S-curves. The spring element 15 provides for a jerk-free transmission of lateral coupling forces particularly when strong lateral excursions of one of the trucks 3, 5 occur with the spring element 15 under tension as well as under the compressive stress of the transverse steering rod 12***a*.

The horn shaped brackets 13 protrude downwardly from the frames 4 of the trucks 3, 5 to such a height that the connecting points provided for linking on the steering rods 12 each lie in a plane E which is inclined downwardly from the center of the corresponding truck 3, 5 toward the transverse center plane M of the vehicle body 1. As shown in FIG. 1 these planes E pass through the bearing 7 of the king pin 6 and intersect in the vicinity of the transverse center plane at a point S located near or coindicent with the plane of the upper surfaces of the track rails. In the example shown, the position of the plane E is determined by the intersection line and a theoretical point of attack P on the vertical axis N, assumed at one half the height H of the bearing, of the lateral forces to be transmitted between the truck 3, 5 and the vehicle body 1.

When the vehicles travel through a curve, oppositely directed transverse forces are transmitted via the steering rods 12 in a known manner. The reaction forces to these coupling forces then exert a reaction moment via the bearings 14 on the chassis of the vehicle body 1 about the vertical center axis of the body 1. This is compensated by the transverse force couple introduced via the points of attack P. The forces attacking at the two trucks 3, 5 at the bracket 13 and the point P result in two idealized oppositely directed transverse coupling forces of equal magnitude, the action line of which passes through the point of intersection S. The effect of this arrangement is as if the trucks 3, 5 were coupled by two simple tow bars connected in the vicinity of the intersection point S. Because of this statically ideal transmission of the transverse coupling forces, changes of the wheel load distribution between the left and right wheel of the same wheel set are kept small.

Figure 4:
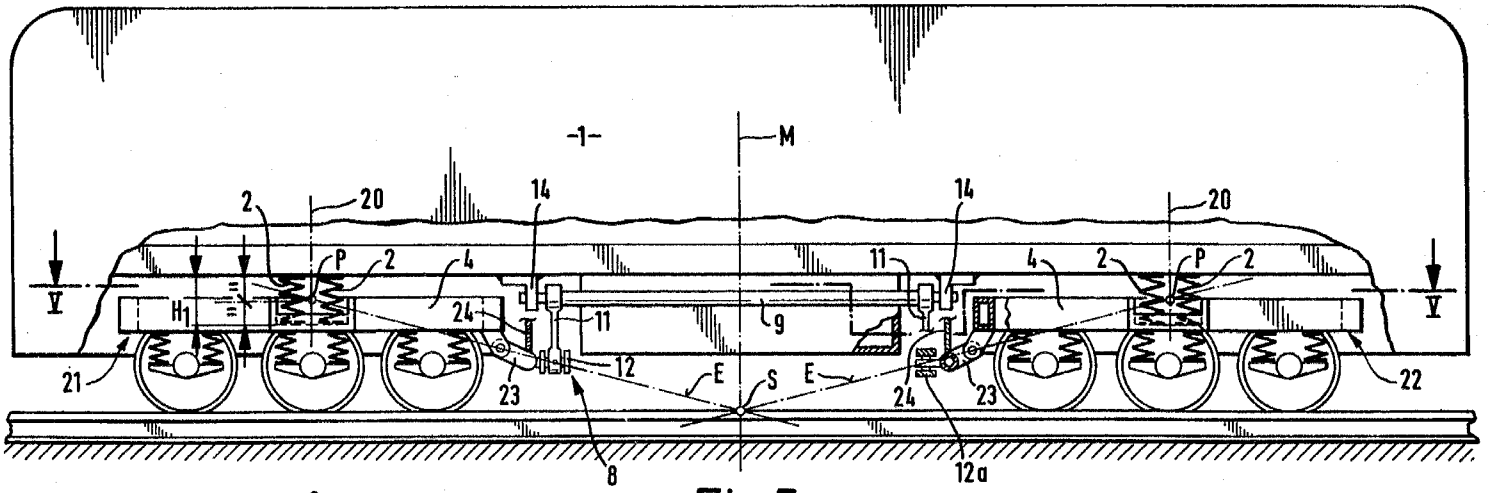
FIG. 4 illustrates a further rail vehicle employing a modified coupling arrangement in accordance with the invention.
Figure 5:
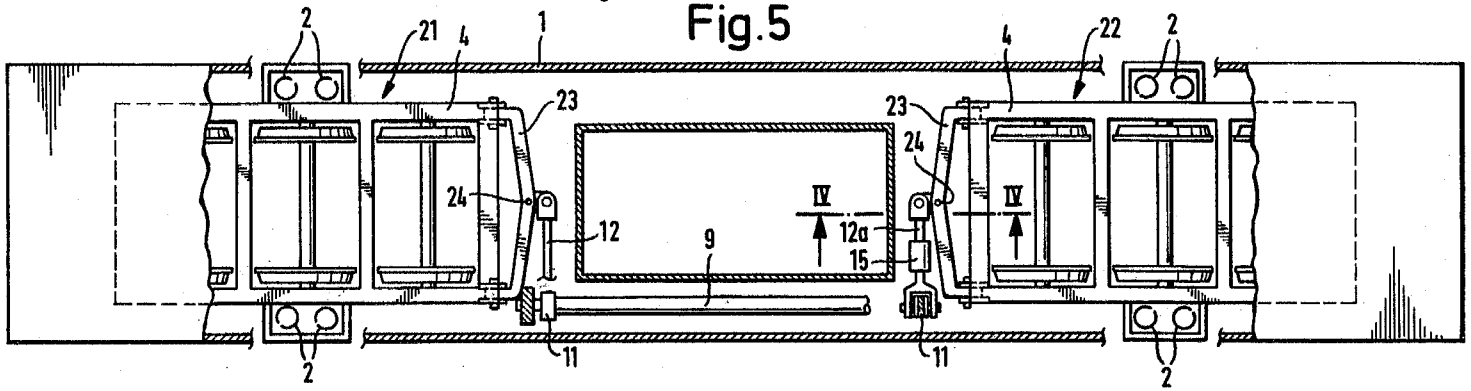
FIG. 5 illustrates a view taken on line V—V of FIG. 4

Referring to FIGS. 4 and 5, the rail vehicle may be alternatively constructed with a vehicle body 1 supported on two three-axle trucks 21, 22 without kingpins. These trucks 21, 22 are each connected to the vehicle body 1 via a device (not shown) for transmitting the traction forces, for example a low-level pulling device, and can rotate relative to the body 1 about an imaginary axis 20. The guide means are in the form of spring elements 2 which are designed as so called "Flexicoil" springs which can be loaded by lateral forces in addition to transmitting the support forces. The trucks 21, 22 are thus guided in the transverse direction by the spring elements 2. The theoretical points of attack P of the lateral forces which result from two spring forces are assumed to be at one half the height $H_1$ of the spring elements 2. Thus, the inclined planes E are determined by these points P and the intersection line passing through the intersection point S.

The transverse coupling arrangement 8 corresponds in substance to that as described with respect to FIGS. 1 to 3 with the difference that the steering rods 12, 12*a* are each linked to a tow bar 23 which, in turn, can rotate at the frame 4 of a respective truck 21, 22 about a horizontal transverse axis. As indicated, the tow bars 23 are each suspended from the vehicle body 1 via a cable 24 in known manner. Also the connection points between the transverse steering rods 12, 12*a* and the trucks 21, 22 or the tow bars connected thereto, each lie in the inclined plane E. Thus, the action lines of the idealized transverse coupling forces pass through the intersection point P in the above described manner.

It is to be understood that the intersection point S may also lie or adjust itself above or below the ideal position shown. For example, in accordance with the prevailing load, track and travel conditions, the intersection point S may be only approximately at the height of the upper rail surfaces.

It is to be noted also that the coupling arrangement can also be used for rail vehicles with three trucks. In this case, the middle truck would not participate in the transverse coupling arrangement.

What is claimed is:

1. In combination with a rail vehicle having at least two trucks each having at least two wheel set axles therein, a vehicle body and a pair of guide members, each said guide member connecting a respective one of said trucks to said vehicle body about a vertical axis for the transmission of lateral forces; a transverse coupling arrangement comprising a shaft extending longitudinally of said vehicle body; means supporting said shaft on said body; and a linkage connecting said trucks to said shaft, said linkage including a pair of pivotal levers connected to said shaft in fixed relation and a pair of transverse steering rods, each said rod being linked to a respective lever and articulated to an end of a respective truck facing the other truck at a predetermined connection point, said connection point lying in an inclined plane passing through said vertical axis of said guide member connecting said respective truck to said body and through a transverse center plane of said body with said inclined planes intersecting at a point coincident with the plane of the upper surfaces of a pair of track rails.

2. The combination as set forth in claim 1 wherein each said guide member includes a kingpin extending vertically from said vehicle body and a bearing in a respective truck rotatably receiving said kingpin.

3. The combination as set forth in claim 1 wherein each said guide member is a spring element capable of being loaded by lateral forces.

4. The combination as set forth in claim 1 wherein each linkage further comprises a horn-shaped bracket secured to each truck and articulated to a respective steering rod.

5. The combination as set forth in claim 1 wherein each linkage further comprises a towbar rotatably mounted on each truck about a horizontal axis and articulated to a respective steering rod.

* * * * *